US010550740B2

(12) United States Patent
Yang et al.

(10) Patent No.: US 10,550,740 B2
(45) Date of Patent: Feb. 4, 2020

(54) MULTIFUNCTIONAL ENGINE BRAKE

(71) Applicant: SHANGHAI UNIVERSOON AUTOPARTS CO., LTD., Shanghai (CN)

(72) Inventors: Zhou Yang, Oak Ridge, NC (US); Rujie Zhu, Shanghai (CN); Yong Xi, Shanghai (CN)

(73) Assignee: Shanghai Universoon Autoparts Co., Ltd., Shanghai (CN)

( * ) Notice: Subject to any disclaimer, the term of this patent is extended or adjusted under 35 U.S.C. 154(b) by 0 days.

(21) Appl. No.: 16/086,379

(22) PCT Filed: Mar. 23, 2017

(86) PCT No.: PCT/CN2017/077783
§ 371 (c)(1),
(2) Date: Sep. 19, 2018

(87) PCT Pub. No.: WO2017/162182
PCT Pub. Date: Sep. 28, 2017

(65) Prior Publication Data

US 2019/0072012 A1 Mar. 7, 2019

(30) Foreign Application Priority Data

Mar. 25, 2016 (CN) ..... 2016 1 0176380
Oct. 18, 2016 (CN) ..... 2016 1 0905887
Mar. 20, 2017 (CN) ..... 2017 1 0166614

(51) Int. Cl.
*F01L 13/06* (2006.01)
*F01L 1/08* (2006.01)
*F01L 1/18* (2006.01)

(52) U.S. Cl.
CPC ..... *F01L 13/06* (2013.01); *F01L 1/08* (2013.01); *F01L 1/181* (2013.01); *F01L 2109/00* (2013.01); *F01L 2800/05* (2013.01)

(58) Field of Classification Search
CPC ... F01L 13/06; F01L 1/08; F01L 1/181; F01L 2109/00; F01L 2800/05
See application file for complete search history.

(56) References Cited

U.S. PATENT DOCUMENTS 7,980,211 B2 7/2011 Ihlemann

FOREIGN PATENT DOCUMENTS

CN 102477880 A1 5/2012
CN 102650224 A1 8/2012
(Continued)

OTHER PUBLICATIONS

International Preliminary Report on Patentability for PCT/CN2017/077783, filed Jun. 27, 2017.
International Search Report for PCT/CN2017/077783, filed Jun. 27, 2017.
Written Opinion for PCT/CN2017/077783, filed Jun. 27, 2017.
(Continued)

*Primary Examiner* — Hieu T Vo
(74) *Attorney, Agent, or Firm* — Zhu Lupkowski LLP

(57) ABSTRACT

A multifunctional engine brake, comprising an engine valve motion transformation mechanism, a slow seating mechanism (250), and a timing oil control mechanism. By axially moving a roller (235) on a roller shaft (231), the connections between the roller (235) and different cams (230, 2302) are switched, so as to implement the transformation between different engine valve motions. A roller axial driving mechanism (100) is disposed in the roller shaft (231), thereby achieving a simple and compact structure, a symmetrical and reliable force, and easy manufacturing and assembling. The timing oil control mechanism provides timing oil supply or discharge for the engine brake, thereby eliminating the randomness of the opening or closing of a conventional
(Continued)

engine brake, avoiding slipping and impact of the roller during roller translation, and improving the reliability and durability of the brake and engine. The slow seating mechanism (250) effectively reduces and controls the seating speed of the valve, thereby eliminating the compact within the mechanism. The brake can be used for different types of variable valve motions, comprising valve motions generating 4-stroke braking, 2-stroke braking, or 1.5-stroke braking.

27 Claims, 6 Drawing Sheets

(56) References Cited

FOREIGN PATENT DOCUMENTS

| | | | |
|---|---|---|---|
| CN | 104314633 | A1 | 1/2015 |
| CN | 104314636 | A1 | 1/2015 |
| CN | 104358600 | A1 | 2/2015 |
| CN | 204140153 | U | 2/2015 |
| CN | 204163782 | U | 2/2015 |
| CN | 204212827 | U | 3/2015 |
| CN | 104712396 | A | 6/2015 |
| CN | 105715323 | A1 | 6/2016 |
| DE | 102007049074 | A | 4/2009 |
| DE | 102010011827 | A1 | 9/2011 |
| JP | 06185322 | A1 | 7/1994 |

OTHER PUBLICATIONS

European Application No. EP 17769459.3, Search Report, dated Sep. 12, 2019.

MULTIFUNCTIONAL ENGINE BRAKE

TECHNICAL FIELD

The invention relates to the field of machinery, in particular to engine braking technology, especially a multifunctional engine brake.

BACKGROUND ART

In the prior art, the conventional engine valve drive technology for the engine ignition is well known and its application has a history of more than one hundred years. However, for the additional requirements on engine emissions and engine braking, more and more engines need different valve motions than conventional valve motions, such as exhaust gas recirculation valve motions that reduce emissions, variable valve motions that increase fuel efficiency (including cylinder cutout with valve motions of zero lift) and engine braking valve motions that slow down the vehicle.

In order to obtain the variable valve motion, for example, from the conventional valve motion to the engine brake valve motion, people often need to add an auxiliary valve drive mechanism (VDM for short) to the conventional VDM, such as a top-mounted brake housing or an integrated brake rocker arm, etc. The structure and control are very complicated, and most of them open the engine valves by hydraulic loading.

The common variable valve motion is a lost-motion type. By changing the linkage between the cam and the valve, some or all of the cam motion is lost and cannot be transmitted to the valve, resulting in reduction or even complete elimination of the valve motion (cylinder cutout). Obviously, the valve motion of the lost-motion type will not completely follow the motion of the cam, and the seating velocity of the valve cannot be controlled by the cam.

The linkage between the cam and the valve can be roughly divided into the fixed chain type and the hydraulic type. Most of VDMs for conventional engine ignition are fixed chain type, with cam direct driving the valve or forming a fixed chain type VDM with solid-to-solid contact through rigid connectors such as a rocker arm (or a push rod and a valve bridge). The cam of the hydraulic variable valve drive mechanism (VVDM for short) is hydraulically linked to the valve, and a (built-in) valve catch (a valve seating mechanism) needs to be provided between the cam and the valve to control the seating velocity of the valve when motion is lost to avoid impact inside the drive mechanism.

For the fixed chain VVDM, there will also be times when the valve motion does not follow the cam motion, such as falling off inside the drive mechanism and valve no-following (bouncing back), which will cause the valve seating velocity to be out of control. Unfortunately, the valve seating mechanism for the hydraulic VVDM cannot be applied to the fixed chain VDM.

The applicant disclosed an engine VVDM by shifting roller in his invention patent application (authorized publication number CN 1043146333 B) on Oct. 15, 2014. The roller drive mechanism shifts the cam roller between the first axial position and the second axial position on the roller shaft through a roller fork, so that the cam roller is connected with different cams and different engine valve events are generated. The roller drive mechanism comprises a piston and a spring, the piston is connected with one end of the roller fork, the other end of the roller fork is provided with two separated guide holes, the two separated guide holes are sleeved on the roller shaft and clamp the cam roller in the middle, and the movement of the piston is transmitted to the cam roller through the roller fork. The engine VVDM from shifting roller can be used for engine cylinder cutout, engine braking, engine exhaust gas recirculation, engine starting and closing, etc.

The above-mentioned fixed chain VVDM by shifting roller still faces two problems. The first is that the roller drive mechanism drives the roller through the roller fork, which is complicated in structure and installation, and the roller fork will generate asymmetric offset load on the roller. The other is that since the brake oil feeding (and brake oil discharging) from the brake oil feed valve is random and not timed (the brake oil feed valve is turned on randomly and the oil can flow to the roller driver at any position/phase of the cam), when the roller moves from one axial position to another axial position on the roller shaft, it is possible to create a transition across two cams of different heights (one cam is in the high position and the other cam is in the low position, rather than two cams are at the same height), resulting in falling off and impact of the roller from the high cam to the low cam.

SUMMARY OF THE INVENTION

The invention aims to provide a multifunctional engine brake, which aims to solve the technical problems in the prior art that the variable valve movement mechanism and the installation thereof are complicated and asymmetric loads exist.

Further, the present invention aims to provide a seating velocity control device for slowing down the valve seating velocity, which solves the technical problem that the fixed chain VVDM in the prior art may have high valve seating velocity and impact noise.

Further, it is an object of the present invention to provide a timed oil feed method and mechanism for driving an engine brake (including a shift roller mechanism), which aims to solve the technical problem in the prior art that the roller falls off and impacts from the high cam to the low cam due to the randomness of oil feeding or discharging by the feed valve to the roller drive mechanism.

The multifunctional engine brake of the present invention comprises an engine valve motion conversion mechanism, and it is characterized in that the engine valve motion conversion mechanism comprises camshaft, roller, roller shaft, roller shaft housing and an axial roller driving mechanism, the camshaft is provided with two or more different cams, the roller shaft housing is provided with a roller groove, both ends of the roller shaft are mounted into the roller shaft housing, the middle of the roller shaft spans the roller groove, the length of the roller shaft in the roller groove is longer than the axial length of the roller, and the roller is arranged on the roller shaft in a rotatable way. The roller is also slidable axially and has two or more axial positions on the roller shaft, the axial roller driving mechanism comprises a piston driving mechanism arranged in the roller shaft, the piston driving mechanism in the roller shaft moves the roller from one axial position to another axial position on the roller shaft, and different engine valve motions are generated by switching the links between the roller and the different cams.

Further, the two or more different cams include a conventional cam and an engine brake cam, and the different engine valve motions include a conventional valve motion and an engine brake valve motion.

Further, the piston drive mechanism comprises a drive piston and a drive spring arranged in the roller shaft, wherein one end of the drive piston is acted by fluid and the other end of the drive piston is acted by the drive spring, and the drive piston drives the roller on the roller shaft through a connector.

Further, the connector comprises at least one drive pin, one end of the drive pin is mounted on the drive piston in the roller shaft, the other end of the drive pin is connected with the roller on the roller shaft, and the middle part of the drive pin passes through an axial groove on the roller shaft.

Further, the camshaft is parallel to the roller shaft, and the roller is linked to only one of the two or more different cams at each axial position on the roller shaft, and the cam generates corresponding engine valve motion.

Further, the multifunctional engine brake further comprises a seating velocity control mechanism, wherein the seating velocity control mechanism is arranged between one end of the roller shaft housing and the engine valve, and the seating velocity control mechanism comprises a positioning mechanism and a flow limiter, and the flow through the flow limiter decreases with the reduction of engine valve seating distance.

Further, the positioning mechanism comprises a connector and a position adjuster, one end of the connector is fixed on the engine, the position adjuster is arranged at the other end of the connector, the flow limiter is arranged in the roller shaft housing, and a positioning lash is arranged between the position adjuster and the roller shaft housing or the flow limiter.

Further, the multifunctional engine brake also comprises a directional valve mechanism, which controls the oil feeding and discharging of the axial roller drive mechanism.

Further, the multifunctional engine brake further comprises an accumulator which reduces oil pressure fluctuation so that the axial roller drive mechanism can feed oil continuously and stably.

Further, the multifunctional engine brake also comprises an oil control timing mechanism, which comprises a timing valve system to control the timing or phase of oil feeding or discharging of the engine brake.

Further, the roller shaft housing comprises a rocker arm of the engine, and the timing valve system comprises a directional valve, wherein the directional valve is positioned in the rocker arm; when the rocker arm rotates to a predetermined angle, the timing valve system is turned on, the directional valve in the rocker arm is shifted, and oil is fed to or discharged from the engine brake.

Further, the timing valve system further comprises a timing piston and a timing piston stop mechanism, wherein the timing piston is positioned in the rocker arm at a predetermined position by the timing piston stop mechanism, wherein the timing piston closes the oil passage to the directional valve; When the cam drives the rocker arm to rotate, the timing piston makes a relative movement in the rocker arm. When the relative movement is greater than a predetermined distance, the timing piston opens the oil passage to the directional valve, the directional valve in the rocker arm is shifted, and oil is fed to or discharged from the engine brake.

The invention also discloses an oil control timing method for driving the engine brake, which comprises an oil control timing process for controlling the oil feeding time or the oil discharging time of the engine brake by using an oil control timing mechanism, wherein the engine brake comprises a non-timing brake oil feed valve, the oil control timing mechanism comprises a timing oil path and a timing valve system, the timing oil path connects the brake oil feeding valve with the timing valve system, and the timing valve system controls the time or phase of oil feeding to or oil discharging from the engine brake, and it is characterized in that the oil control timing process comprises the following steps: firstly, turning on the brake oil feeding valve; Secondly, the timing valve system is turned on for a predetermined period of time or phase within the engine cycle, and finally, oil is fed to or discharged from the engine brake.

Further, the timing valve system includes a directional valve located in the rocker arm of the engine. When the rocker arm rotates to a predetermined angle, the timing valve system opens an oil passage to the directional valve, oil pressure drives the directional valve in the rocker arm to move, and oil is fed to or discharged from the engine brake.

Further, the timing valve system further comprises a timing piston and a timing piston stop mechanism, wherein the directional valve and the timing piston are positioned in the rocker arm of the engine, the timing piston is positioned at a predetermined position by the timing piston stop mechanism, and in the predetermined position, the timing piston closes the oil passage to the directional valve; When the cam drives the rocker arm to rotate, the timing piston makes a relative movement in the rocker arm. When the relative movement is greater than a predetermined distance, the timing piston opens the oil passage to the directional valve, oil pressure drives the directional valve in the rocker arm to move, and oil is fed to or discharged from the engine brake.

The working principle of the invention: when it is necessary to convert the normal ignition operation of the engine into other operation modes (e.g. engine braking), the valve motion control mechanism (e.g. brake oil feed valve) is turned on, the axial roller drive mechanism moves the roller between different axial positions on the roller shaft, and the connection between the roller and different cams (e.g. ignition cam and brake cam) is switched to generate different engine valve motions (e.g. ignition valve motion and brake valve motion).

During the above-mentioned conversion of engine operation modes, if there is a falling off in the inside of the fixed-chain VVDM and the valve is out of control to have a high velocity seating, the seating velocity control mechanism will generate more and more resistance to the rocker arm or valve bridge of the fixed-chain VVDM, make its motion slower and slower, thus effectively slow down and control the valve's seating velocity.

Another effective way to reduce falling off inside the VVDM is to use an oil control timing (oil feeding and discharging) mechanism. When the no-timing brake oil feed valve is turned on or off to feed or discharge oil randomly, the engine brake will not necessarily to follow to turn on or off immediately, but oil is fed to or discharged from the engine brake through the timing valve system of the oil control timing mechanism at a predetermined timing or phase within the engine cycle (for example, when the rocker arm of the engine rotates within a predetermined angle range), so that the engine brake is timed (at a predetermined time or phase) to turn on or off.

Compared with the prior art, the present invention has positive and obvious effects. According to the invention, the drive mechanism in the roller shaft moves the roller to different axial positions on the roller shaft to realize the conversion of different engine valve motions. The axial roller drive mechanism is placed in the roller shaft, which has the advantages of simple and compact structure, symmetrical and reliable loading, easy manufacture and assembly, convenient and wide application, etc. Since different cams are independent of each other, their performance can be optimized. For example, the brake cam includes at least one but not more than four brake lobes, resulting in four-stroke braking, two-stroke braking, or one-point five-stroke braking. Transmission of load through mechanical linkage eliminates the defects or failure modes of traditional hydraulic engine brakes such as high oil pressure, high deformation, high leakage and hydraulic jacks caused by hydraulic loading.

In addition, the present invention supplies oil to the engine brake through the oil control timing mechanism, so that the engine brake is turned on at its correct timing, that is to say, the axial position of the engine roller on the roller shaft can be changed only within a predetermined period of time or phase within the engine cycle, so that the roller will not fall off and cause impact during the transition period from one cam's high position to another cam's low position, and the reliability, stability and durability of the roller shifting mechanism are increased.

Furthermore, the seating velocity control mechanism of the present invention can also effectively slow down and control the seating velocity of the valve and the internal impact of the axial roller drive mechanism in event that there is a falling off in the inside of the fixed chain VVDM, such as when the roller slides from the high position of one cam to the low position of the other cam.

EMBODIMENTS

Embodiment 1

Figure 1:
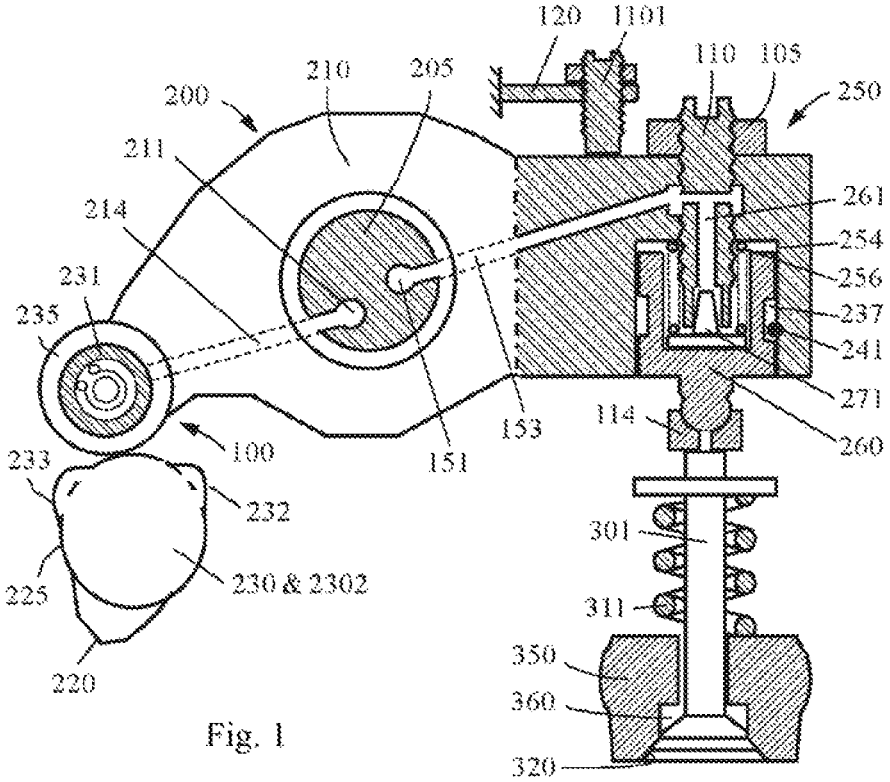
FIG. 1 is an illustration (side view) of an engine valve drive device of an engine valve motion conversion mechanism in embodiment 1.
Figure 2:
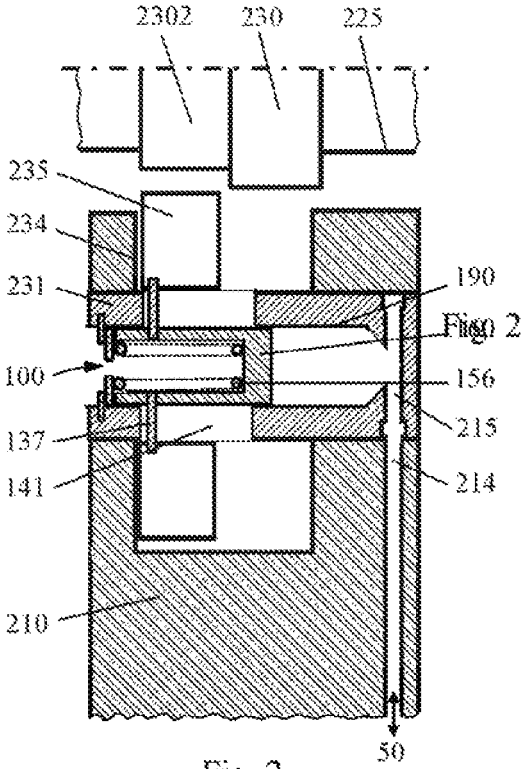
FIG. 2 is an illustration (top partial cross-section view) of the axial roller drive mechanism of the engine valve motion conversion mechanism in embodiment 1 when the roller is in the first axial position.
Figure 3:
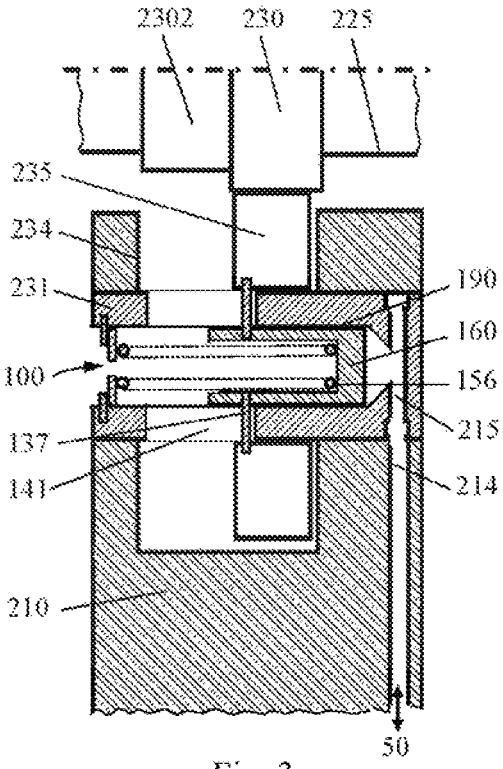
FIG. 3 is an illustration (top partial cross-section view) of the axial roller drive mechanism of the engine valve motion conversion mechanism in embodiment 1 when the roller is in the second axial position.

FIGS. 1, 2 and 3 are used to describe embodiment 1 of the engine valve motion conversion mechanism in the present invention. FIG. 1 is an illustration (side view) of an engine valve drive device in embodiment 1. The valve actuator 200 (the description herein applies to both the intake valve actuator and the exhaust valve actuator) includes cams (such as a conventional ignition cam 230 and an engine brake cam 2302), a roller 235 and a roller shaft 231. In addition to being able to rotate on the roller shaft 231, the roller 235 can also move axially along the roller shaft 231 (FIGS. 2 and 3). This embodiment shows two different cams 230 and 2302 (for example, the conventional ignition cam 230 and the engine brake cam 2302), which have different profile curves (lift and phase), but they are located on the same camshaft, adjacent to each other and have the same or approximately the same inner base circle 225. The valve actuator 200 also includes a rocker arm (also called a roller shaft housing) 210 mounted on a rocker arm shaft 205 in a rotatable way. In general, the rocker arm 210 acts on the engine valve 301 through a valve lash adjustment mechanism (here, a single valve is shown, but the present invention is also applicable to a dual valve engine, but a valve bridge needs to be added when dual valves are used). The valve 301 is biased to the valve seat 320 of the engine block 350 by the valve spring 311, preventing gas from flowing between the engine cylinder and the gas manifold 360.

The end of the rocker arm 210 close to the valve 301 may also be provided with a seating velocity control mechanism 250, which is composed of a positioning mechanism and a flow limiter (FIG. 1), wherein the positioning mechanism includes a connector 120. One end of the connector 120 is fixed to the engine, and the other end is provided with a position adjuster, which is connected to the rocker arm (roller shaft housing) 210 through an adjustment screw 1101, and a positioning lash is provided between the rocker arm 210 and the positioning adjuster. The flow limiter includes a flow limiting piston 260 and a flow limiting valve 271, which is located between the flow limiting piston 260 and the valve lash adjuster and is biased to the bottom surface of the flow limiting piston 260 by a flow limiting spring 256. The valve lash adjuster is installed on the rocker arm (roller shaft housing) 210 (it may also be installed at other positions of the rocker arm, such as below the roller side). The stroke of the limit piston 260 is determined by the pin 241 and the annular groove 237. The flow limit piston 260 is connected to the engine valve 301 through the lower elephant foot pad 114. The valve lash adjuster includes a valve lash adjusting screw 110 and a lock nut 105 for adjusting the valve lash. The valve lash is firstly set using the valve lash adjuster on the rocker arm 210, and then the positioning lash is set using the position adjuster on the engine, and the positioning lash must be smaller than the valve lash. In this way, the positioning mechanism slightly separates the roller 235 on the rocker arm (roller shaft housing) 210 from the base circle 225 of the cam (there is a small gap) to reduce the friction and impact between the roller 235 and the base circle 225 when the roller 235 moves on the roller shaft 231.

FIGS. 2 and 3 are illustrations (top partial cross-section view) of the axial roller drive mechanism 100 in embodiment 1 when the roller 235 is positioned at different axial positions. Rocker arm (shown here may also be cam followers of push rod engines, which are commonly referred as roller shaft housings) 210 is provided with a roller groove 234 near one end of the rocker arm close to the cam. Both ends of the roller shaft 231 are disposed in the rocker arm 210 with the middle spanning the roller groove 234. The roller 235 is arranged on the roller shaft 231 in a rotatable way, the length of the roller shaft 231 in the roller groove 234 is larger than the axial length of the roller 235, and an axial sliding pair is also formed between the roller 235 and the roller shaft 231. The axial roller drive mechanism 100 moves the roller 235 from one axial position to another axial position on the roller shaft 231. The axial roller drive mechanism 100 composes a piston drive mechanism in the roller shaft 231, including a drive piston 160 and a drive spring 156 disposed in a drive piston bore 190 in the roller shaft. One side of the drive piston 160 is actuated by fluid (such as engine oil), and the other side of the drive piston 160 is acted by the drive spring 156. The drive piston 160 drives the roller 235 on the roller shaft 231 through a connector. The connector here includes at least one drive pin 137, one end of which is placed in the drive piston 160 in the roller shaft, the other end of which is connected to the roller 235 on the roller shaft, and the middle part of the drive pin 137 passes through a slot 141 in the roller shaft. The drive pin 137 and the drive piston 160 can be connected in various ways, such as a static fit (an interference fit) or a dynamic fit. The drive pin 137 is connected to the roller 235 in a dynamic fit (e.g., a pin-slot fit) to ensure that the roller 235 can rotate on the roller shaft 231.

Figure 7:
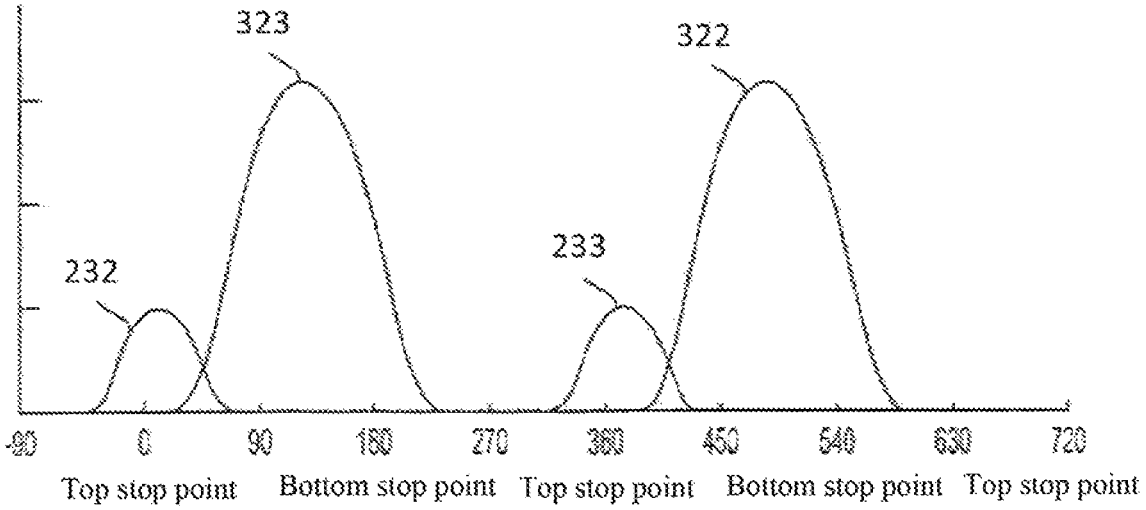
FIG. 7 is a schematic diagram of engine valve motion generated by the engine valve motion conversion mechanism in the engine braking state.

When it is necessary to convert the engine ignition valve motion into the engine braking valve motion, the engine brake oil feed valve 50 is turned on to feed oil to the engine brake. The oil flows into the drive piston bore 190 from the brake oil passage, such as the axial hole 211 in the rocker shaft 205, the oil hole 214 in the rocker arm 210, and the oil hole 215 in the roller shaft 231. One side (right side in FIG. 2) of the drive piston 160 is subjected to oil pressure, which moves the drive piston 160 to the left in the drive piston bore 190 against the force of the drive spring 156 on the other side of the drive piston 160. The roller 235 is pushed to the axial position shown in FIG. 2, connected to the engine brake cam 2302 on the left and transmits the mechanical motion generated by the brake cam 2302 to the engine valve to generate the engine brake valve motion as shown in FIG. 7 (exhaust valve lift 232 and 233 and intake valve lift 322 and 323 for two-stroke braking). At the same time, the ignition cam 230 is disconnected from the roller 235, and the valve motion for the engine ignition is completely lost.

Figure 6:
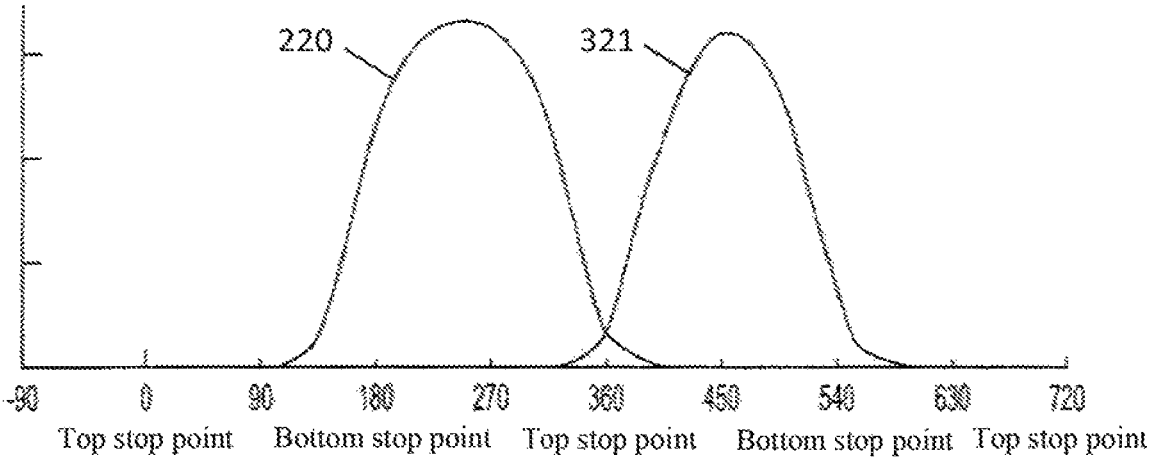
FIG. 6 is a schematic diagram of engine valve motion generated by the engine valve motion conversion mechanism when the engine is in an ignition state.

When engine brake is not required, the engine brake oil feed valve 50 is turned off to discharge oil from the engine brake, and without oil pressure the drive piston 160 moves to the right under the action of the drive spring 156, which moves the roller 235 to the axial position shown in FIG. 3. The roller 235 is now connected to the engine ignition cam 230 on the right, and transmits the mechanical motion generated by the ignition cam 230 to the engine valve to generate the engine ignition valve motion shown in FIG. 6 (exhaust valve lift 220 and intake valve lift 321). At the same time, the brake cam 2302 is disconnected from the roller 235, and the valve motion for the engine braking is completely lost.

When the roller 235 moves from one axial position to another axial position on the roller shaft 231, a falling off (from a high position of one cam to a low position of the other cam) and impact may occur between the roller 235 and the cam 230 or 2302. The seating velocity control mechanism 250 may be used to eliminate or reduce such impact. Once such falling off happens, it will result in a large gap (or separation) in the valve drive chain. The engine oil (lubricating oil) enters the flow limiting piston bore 254 through the lubricating oil passage, such as the axial oil passage 151 in the rocker arm shaft 205, the oil hole 153 in the rocker arm 210 and the oil hole 261 in the adjusting screw 110 shown as FIG. 1. The oil pressure and the flow limiting spring 256 cause the flow limiting piston 260 and the flow limiting valve 271 to move downward in the flow limiting piston bore 254, increasing the distance between the valve lash adjusting screw 110 and the flow limiting valve 271. At the same time, the valve 301 is accelerated upward toward the valve seat 320 under the action of the valve spring 311. Before the valve 301 impacts the valve seat 320, liquid between the valve lash adjusting screw 110 and the flow limit valve 271 in the flow limit piston bore 254 needs to be drained back from the oil hole 261 to the main oil passage of the engine. Due to the flow restricting mechanism of the flow-limiting valve 271, when the distance between the valve lash adjusting screw 110 and the flow-limiting valve 271 becomes smaller, the flow area thereof is correspondingly reduced, and the discharging flowrate is reduced, thus reducing the seating velocity of the valve 301. In addition, before the roller 235 impacts the cam 230 or 2302, the rocker arm 210 first contacts the positioning mechanism (positioning adjustment screw 1101) to eliminate the impact between the roller and the cam.

It is noted that the above description applies to both exhaust and intake valves as well as single and double valve actuation.

Embodiment 2

Figure 4:
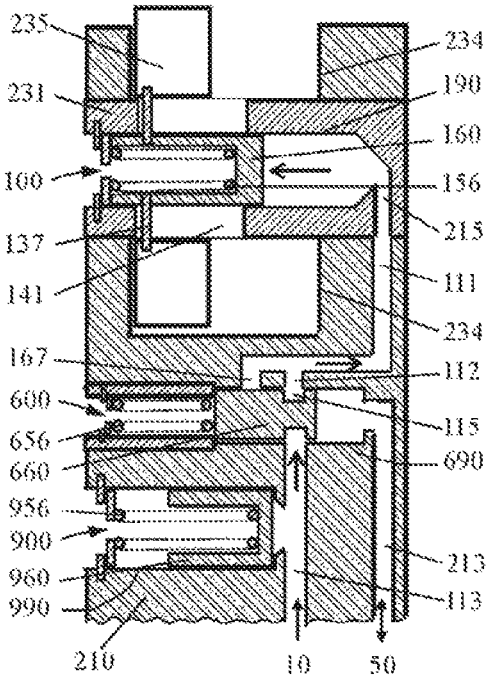
FIG. 4 is an illustration (top partial cross-section view) of the axial roller drive mechanism of the engine valve motion conversion mechanism in embodiment 2 in the brake oil feeding state.
Figure 5:
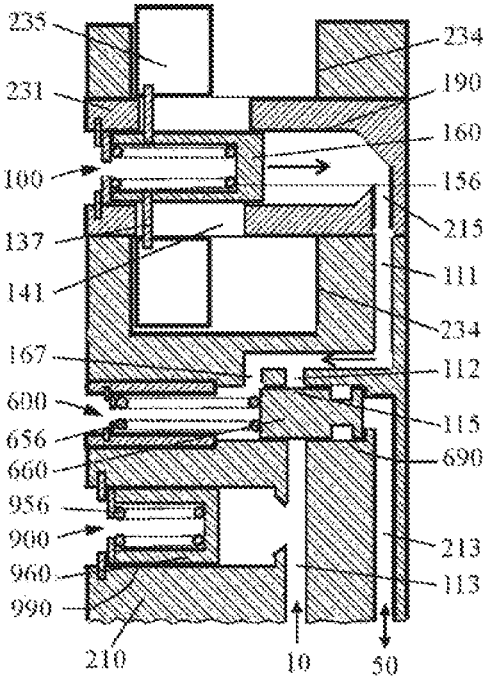
FIG. 5 is an illustration (top partial cross-section view) of the axial roller drive mechanism of the engine valve motion conversion mechanism in embodiment 2 in the brake oil discharging state.

FIGS. 4 and 5 are used to describe embodiment 2 of the engine valve motion conversion mechanism in the present invention. The main difference between this embodiment and the above embodiment 1 is the oil feeding mode of the axial roller drive mechanism 100. In this embodiment, a directional valve mechanism 600 and an accumulator 900 are added to the rocker arm (roller shaft housing) 210. The directional valve mechanism 600 includes a directional piston 660 and a directional spring 656. One side of the directional piston 660 in the directional piston bore 690 is acted upon by fluid (e.g., oil pressure) and the other side is acted upon by a directional spring 656. The accumulator 900 includes an oil storage piston 960 and an oil storage spring 956. One side of the oil storage piston 960 is acted upon by fluid (e.g., oil pressure) and the other side is acted upon by the oil storage spring 956, so the piston 960 can move between a non-oil storage position (FIG. 4) and a full oil storage position (FIG. 5) in the oil storage piston bore 990. The accumulator 900 reduces oil pressure fluctuation, so that the oil can be fed to the axial roller drive mechanism 100 continuously and stably.

When engine braking is required, the engine brake oil feed valve 50 is turned on to feed oil (brake oil feeding) to the directional piston bore 690 from the brake oil passage, such as the axial hole 211 in the rocker arm shaft 205 and the oil hole 213 in the rocker arm 210. One side (right side in FIG. 4) of the directional piston 660 is subjected to oil pressure that overcomes the force of the directional spring 656 on the other side of the directional piston 660, which moves the directional piston 660 to the left in the directional piston bore 690 to reach a position shown in FIG. 4. The directional piston 660 blocks the oil discharge hole 167, at the same time, the annular groove 115 on the directional piston 660 is aligned with the lubricating oil hole 113 (interconnecting with the axial oil hole 151 in the rocker shaft 205 shown as in FIG. 1). The lubricating oil 10 from the engine oil pump flows into the drive piston bore 190 through the oil inlet hole 112, the oil passage 111 and the oil hole 215 in the roller shaft 231, moves the drive piston 160 leftward in the drive piston bore 190, and pushes the roller 235 to the axial position as shown in FIG. 4. Therefore, in this embodiment, during engine braking, the oil fed to the axial roller drive mechanism 100 is not from the brake oil feed valve 50, but from the lubricating oil 10 in the lubricating oil passages 113 and 151 through the directional valve mechanism 600, which has advantages of fast reaction (lubricating oil 10 does not come from brake oil feed valve 50) and high flow rate (lubricating oil 10 is not limited by brake oil feed valve 50).

When the engine brake is not required, the engine brake oil feed valve 50 is turned off to discharge oil (brake oil discharging), and without oil pressure, the directional piston 660 moves rightward under the action of the directional spring 656 to reach the position shown in FIG. 5. The directional piston 660 opens the oil discharge hole 167 and blocks the lubricating oil hole 113 as well as the oil inlet hole 112. Oil is discharged from the drive piston bore 190 in the roller shaft 231, and the drive piston 160 is moved to the right under the action of the drive spring 156, pushing the roller 235 toward the axial position for engine ignition. Therefore, the axial roller drive mechanism 100 discharges oil directly to the outside through the oil discharge hole 167 instead through the long brake oil passages and the brake oil feed valve 50 with limited flowrate, thus greatly accelerates the oil discharge speed.

Embodiment 3

Figure 8:
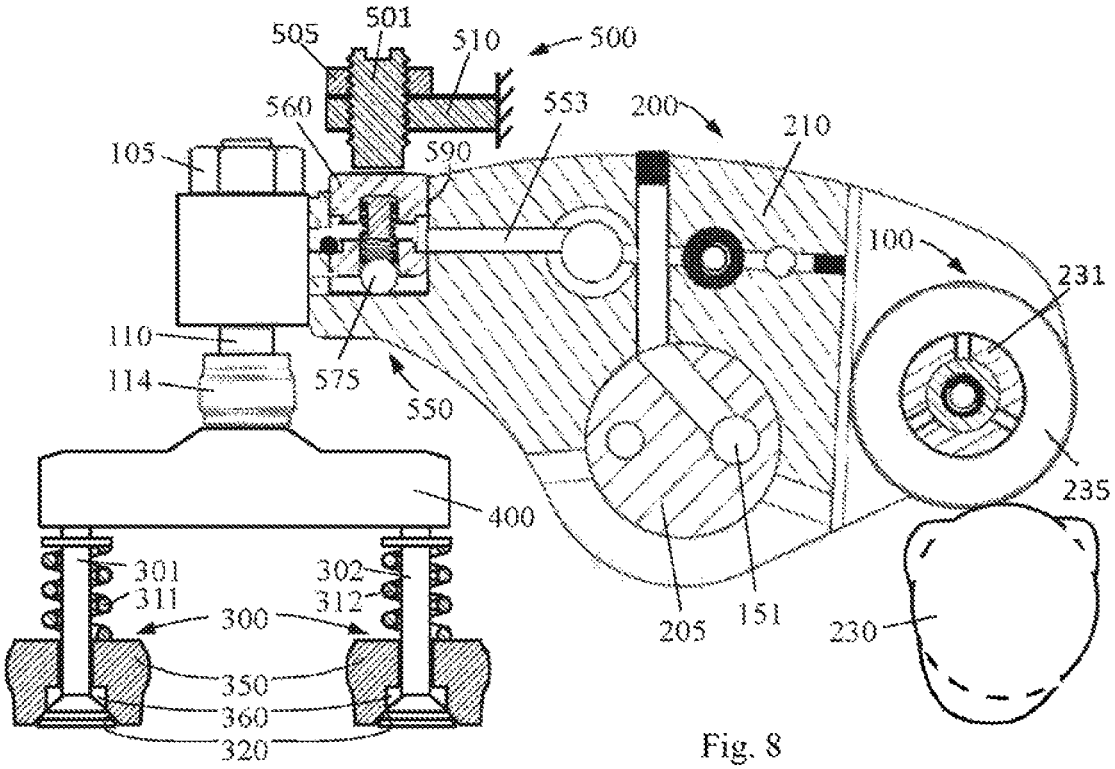
FIG. 8 is an overall illustration (side view) of the seating velocity control device in embodiment 3.
Figure 9:
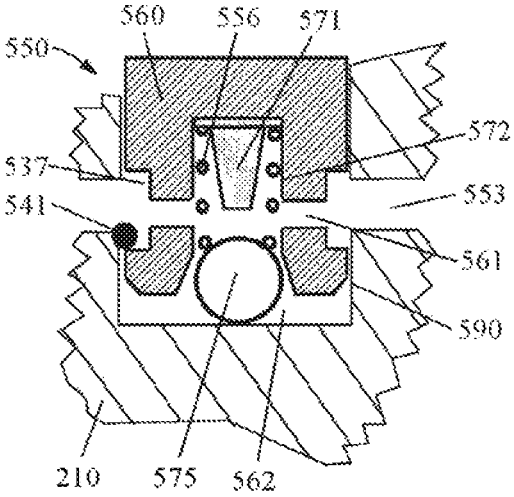
FIG. 9 is a partially enlarged view of the seating velocity control device in embodiment 3 with the flow limit mechanism at the "high position" (maximum flow rate of the flow limit valve).
Figure 10:
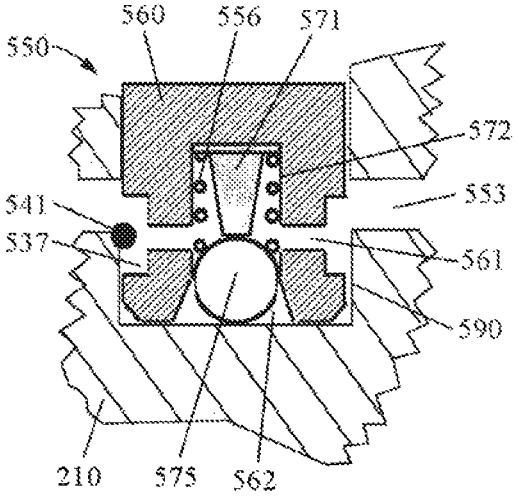
FIG. 10 is a partially enlarged view of the seating velocity control device in embodiment 3 with the flow limit mechanism at the "low position" (minimum flow rate of the flow limiting valve).

FIGS. 8, 9 and 10 are used to describe embodiment 3 of the seating velocity control device in the present invention. FIG. 8 is an illustration (side view) of embodiment 3 of the seating velocity control device in the present invention. The rocker arm 210 is connected to the valve bridge 400 on the end close to the valve 300 through a conventional valve lash adjustment mechanism, and the valve bridge 400 acts on both engine valves 300 (301 and 302) (here, a dual valve engine is shown, but the present invention is also applicable to a single valve engine). The two valves 301 and 302 are biased to the valve seat 320 of the engine block 350 by the valve springs 311 and 312, respectively so as to prevent gas from flowing between the engine cylinder and the gas manifold 360. The conventional valve lash adjusting mechanism includes a valve lash adjusting screw 110, a lock nut 105, and an elephant foot pad 114. From the above description, it can be seen that the valve actuator 200 here is a fixed chain type VVDM, the drive members (such as the cam 230, the rocker arm 210 and the valve bridge) and the valve 300 form a direct solid-solid contact, and there is no hydraulic linkage inside the drive mechanism. The roller drive mechanism 100 shifts the roller 235 on the roller shaft 231 of the rocker arm 210 away from the conventional cam 230 to eliminate the conventional valve motion of the engine (suitable for cylinder cutout or two-stroke braking of the engine).

The seating velocity control mechanism of embodiment 3 includes a flow limiter 550 and a positioning mechanism 500 (FIG. 8). The flow limit mechanism 550 includes a buffer piston 560 and a flow limit valve 575, which are disposed in the piston bore 590 facing upward in the rocker arm 210 near the end of the valve 300. The flow limit valve 575 includes a ball valve formed by a ball biased to the bottom of the piston bore 590 by a spring 556, and the other side of the spring 556 is disposed on the spring seat 571. The ball, the spring 556 and the spring seat 571 are all located in the bore 572 of the buffer piston 560. The positioning mechanism 500 is provided above the buffer piston 560 and is fastened to the engine body through the connector 510. The positioning mechanism 500 includes an auxiliary lash adjusting mechanism, in which the adjusting bolt 501 (fastened to the connector 510 by the nut 505) sets the lash between the rocker arm 210 and the positioning mechanism 500 through the buffer piston 560. The relative movement between the rocker arm 210 and the positioning mechanism 500 determines the flow rate of the flow limit valve 575. Therefore, the seating velocity control mechanism here is not between the cam 230 and the valve 300 (inside the VDM), but between the rocker arm 210 and the engine body (outside the VDM), which may be referred to as an external seating velocity control mechanism.

When the rocker arm 210 is separated from the positioning mechanism 500 (engine body) (the valve 300 opens downward), the buffer piston 560 moves outward (upward) from the piston bore 590 in the rocker arm 210 until the pin 141 of the stop mechanism stops the buffer piston 560 through the annular groove 537. At this time, the flow limit mechanism 550 is in the "high position" (FIG. 9), and the flow limit valve 575 (between the ball and the hole 572) has the maximum flow rate. Fluid, such as engine oil, fills the hydraulic pressure chamber 562 between the buffer piston 560 and the piston bore 590 through the oil passages 151, 553 and the flow limit valve 575.

When the rocker arm 210 is getting close to the positioning mechanism 500 (engine body) (the valve 300 is seating and closing upward), the positioning mechanism 500 (adjusting bolt 501) prevents the upward movement of the buffer piston 560, and the buffer piston 560 moves inward (downward) in the piston bore 590 of the rocker arm 210, so that the flow rate of the flow limit valve 575 becomes smaller, and the pressure (also the resistance acting on the rocker arm 210) in the hydraulic chamber 562 between the buffer piston 560 and the piston hole 590 increases, slowing down the movement of the rocker arm 210 and the seating velocity of the engine valve 300. When the buffer piston 560 approaches or rests on the bottom surface of the piston bore 590, the flow limit mechanism 550 is in the "low position" (FIG. 10) and the flow limit valve 575 (between the ball and the hole 572) has the minimum flow rate.

The fixed chain type VVDM may also suffer a situation that the valve seating velocity is too high. For example, the valve bounces off, the roller falling off between the cams or in the VDM, all of which will cause the opened valve to get out of control and to have a high velocity seating. For example, when the roller 235 in FIG. 8 moves from one axial position to another axial position on the roller shaft 231 at an improper timing, falling off may occur between the roller 235 and the cam 230 (the roller slides from the high position of one cam to the low position of the other cam). Once the above situation occurs, one side of the roller 235 on the rocker arm 210 may be suspended in the air (separated from the cam 230). The opened valve 300 is accelerated upward to the valve seat 320 by the action of valve springs 311 and 312. Before the valve 300 impacts the valve seat 320, the buffer piston 560 in the piston bore 590 of the rocker arm 210 contacts the positioning mechanism 500 (adjusting bolt 501) fixed to the engine block and stops moving upward. However, the rocker arm 210 continues to move upward under the push of the valve 300, and the buffer piston 560 moves inward (downward) in the piston hole 590, making the flow rate of the flow limit valve 575 smaller, so as to slow down the discharge flow and increase the pressure (also the resistance acting on the rocker arm 210) in the hydraulic chamber 562 between the buffer piston 560 and the piston bore 590, slow down the upward movement of the rocker arm 210 and the seating velocity of the engine valve 300, and also eliminate the impact between the roller 235 and the cam 230.

Embodiment 4

Figure 11:
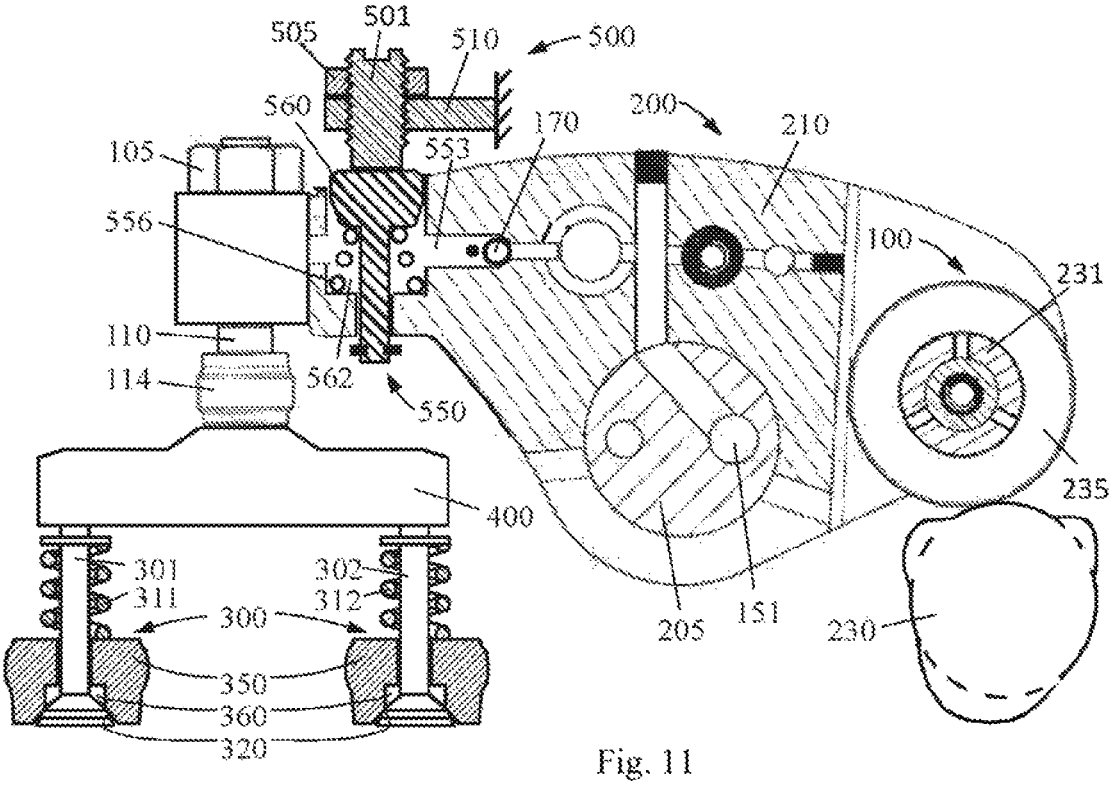
FIG. 11 is a general schematic view (side view) of a seating velocity control device in embodiment 4.
Figure 12:
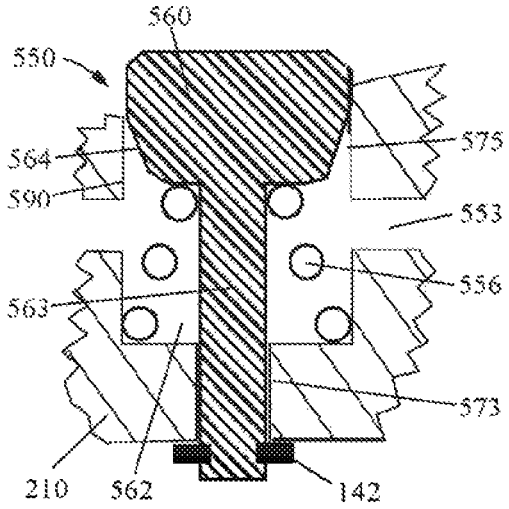
FIG. 12 is a partially enlarged view of the seating velocity control device in embodiment 4 with the flow limit mechanism at the "high position" (maximum flow rate of the flow limit valve).

FIGS. 11 and 12 are used to describe embodiment 4 of a seating velocity control device in the present invention. The main difference between this embodiment and the above embodiment 3 is the flow limiter 550. The flow limiting valve 575 of the flow limiter 550 is formed by the upper end of the buffer piston 560 and the piston bore 590 on the rocker arm 210 (FIG. 12).

The upper end of the buffer piston 560 has a profile 564 for controlling the discharging flow rate, forming a spool valve. The lower end of the buffer piston 560 is a guide rod 563 located in a guide hole 573 in the rocker arm 210. In order to form a closed hydraulic chamber 562 between the buffer piston 560 and the piston bore 590, a one-way valve 170 (FIG. 11) is added upstream of the oil feed passage 553.

When the rocker arm 210 is separated from the positioning mechanism 500 (engine body) (the valve 300 opens downward), the buffer piston 560 moves outward (upward) from the piston bore 590 of the rocker arm 210 until the snap ring 142 of the stop mechanism stops the buffer piston 560 (FIG. 12). At this time, the flow limit mechanism 550 is in the "high position" and the flow discharged from the flow limit valve 575 (between the buffer piston 560 and the piston bore 590) is the highest. Fluid, such as engine oil, fills the hydraulic chamber 562 between the buffer piston 560 and the piston bore 590 through the oil passages 151, 553 and the check valve 170.

When the rocker arm 210 is getting close to the positioning mechanism 500 (engine body) (the valve 300 is seating and closing upward), the positioning mechanism 500 (adjusting bolt 501) prevents the movement of the buffer piston 560, but the rocker arm 210 continues to move upward under the push of the valve 300, causes the buffer piston 560 to move inward (downward) in the piston bore 590 of the rocker arm 210, reducing the discharging flowrate of the flow limit valve 575, increasing the pressure in the hydraulic chamber 562 between the buffer piston 560 and the piston bore 590 (also the resistance acting on the rocker arm 210), slow down the movement of the rocker arm 210 and the seating velocity of the engine valve 300.

The flow limiter shown here may also be arranged in the valve bridge of the engine, and the valve body of the flow limiter needs not be a sphere or a cylinder, and its shape, size, position and installation mode may all be altered.

Embodiment 5

Figure 13:
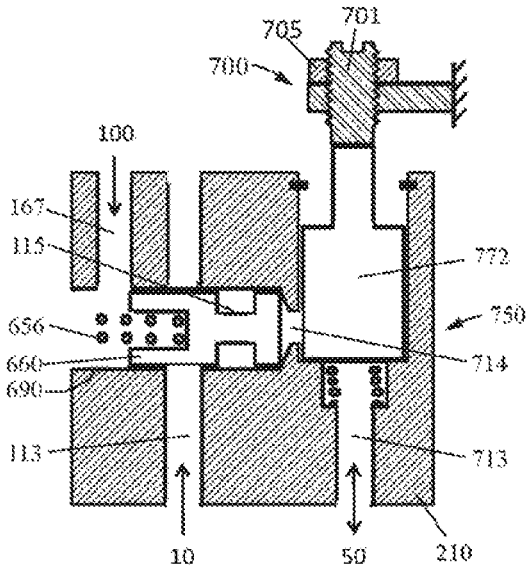
FIG. 13 is a schematic diagram showing the timing valve system in the off state in embodiment 5.
Figure 14:
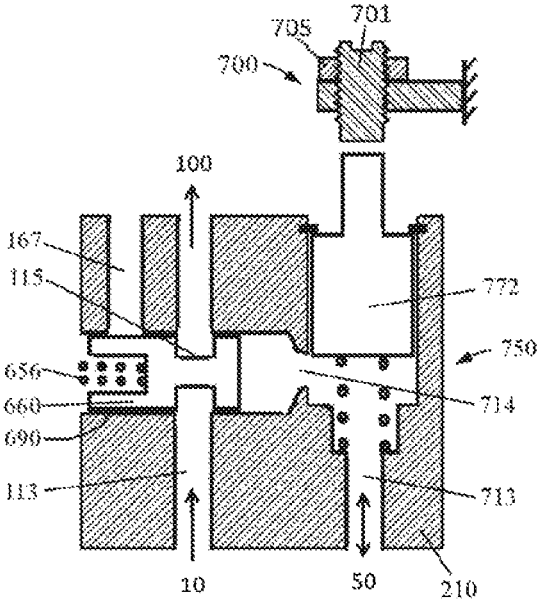
FIG. 14 is an illustration of the timing valve system in the on state in embodiment 5.

FIGS. 13 and 14 are used to describe embodiment 5 of the present invention. The timing valve system 750 of the oil control timing mechanism is integrated into the rocker arm (exhaust rocker arm or intake rocker arm) 210 and includes a timing piston 772, a timing piston stop mechanism 700 and a directional piston 660. When the cam of the engine is at the inner base circle position, the rocker arm 210 is at rest. The timing piston 772 in the rocker arm is positioned at a predetermined position as shown in FIG. 13 by the timing piston stop mechanism 700 fixed to the engine (via the adjusting screw 701 and the lock nut 705).

When the engine braking is required, the brake oil feed valve 50 (the usual oil feed valve without timing function which can be turned on or off at a random engine timing) is turned on to feed oil to the timing piston 772 through the timing oil passage 713. However, at this time, the timing piston 772 is held still by the timing piston stop mechanism 700, so that the timing oil passage 714 to the directional valve 660 remains closed, and the directional valve 660 is pressed against the bottom of the piston bore 690 by the spring 656, closing the oil feed passage 113 to the engine brake 100. When the cam of the engine drives the rocker arm 210 to rotate, the rocker arm 210 and the timing piston 772 are separated from the timing piston stop mechanism 700, and the timing piston 772 is forced upward in the rocker arm by oil from the brake oil feed valve 50 in the timing oil passage 713. When the relative movement of the timing piston 772 within the rocker arm is greater than a predetermined distance, the timing oil passage 714 to the directional valve 660 is opened (FIG. 14). The oil pressure overcomes the force of the spring 656 and moves the directional valve 660 to the left. The annular groove 115 on the directional valve aligns with the oil feed passage 113. The lubricating oil 10 from the engine oil pump flows to the engine brake 100 to turn on the engine brake 100.

When the engine braking is not required, the brake oil feed valve 50 (the conventional oil feed valve without timing function which can be turned on or off at a random engine timing) is turned off, and the oil in the directional valve bore 690 in FIG. 14 is discharged to the brake oil feed valve 50 through the timing oil passages 714 and 713. The directional valve 660, without oil pressure, moves toward the bottom (right) of the bore under the action of the spring 656, closes the oil feed passage 113 to the engine brake 100 and opens the oil discharge passage 167 (FIG. 13) of the engine brake 100, and the engine brake 100 is turned off after oil discharged.

Embodiment 6

Figure 15:
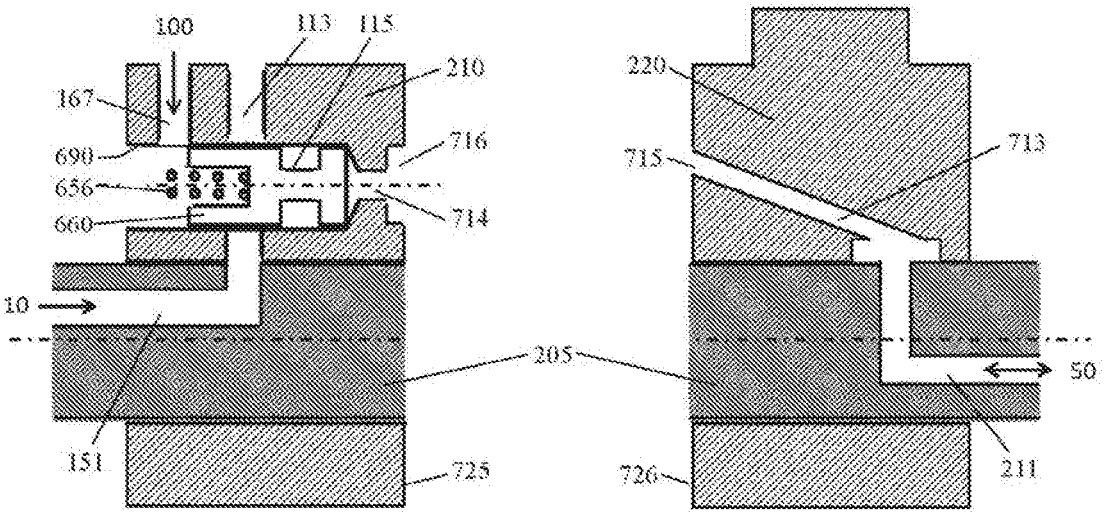
FIG. 15 is a schematic diagram of a timing valve system in embodiment 6.
Figure 16:
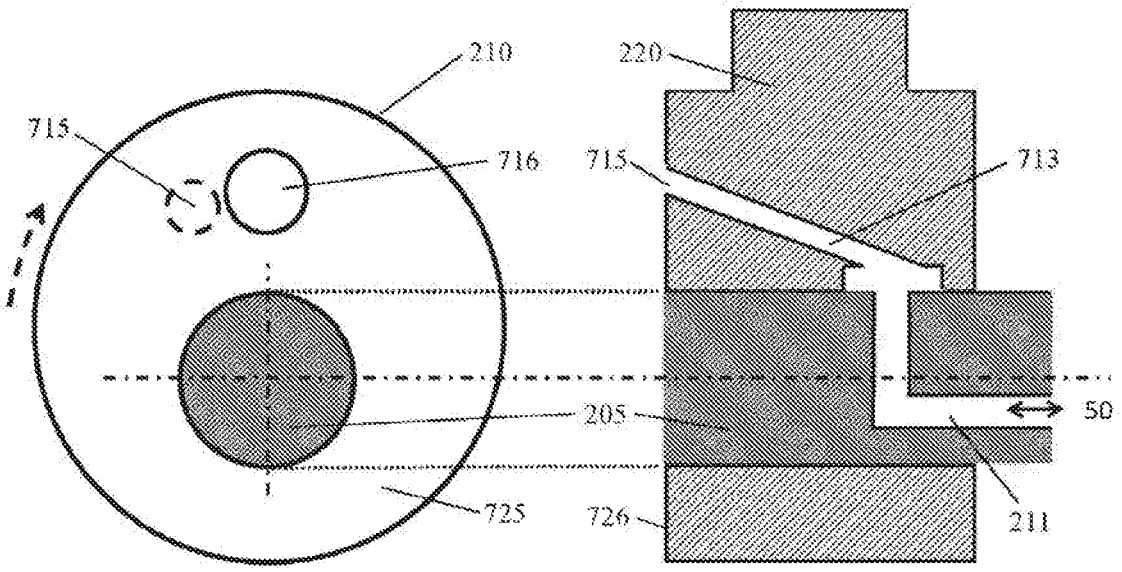
FIG. 16 is a schematic diagram showing the relationship between two timing passage openings of the timing valve system in embodiment 6.

FIGS. 15 and 16 are used to describe embodiment 6 of the oil control timing method and mechanism for driving the engine brake of the present invention. The main difference between this embodiment and the above embodiment 5 is that the timing valve system 750 is provided in the two rocker arms of the engine and there are no timing piston and timing piston stop mechanism. The side 725 of the first rocker arm 210 and the side 726 of the second rocker arm 220 are closely sealed surfaces (the first rocker arm and the second rocker arm may be separated, but a transition piece needs to be added between them to transfer oil). When the cam of the engine is at the inner base circle position, the rocker arm is at rest. The outlet 715 of the timing oil path 713 on the side 726 of the second rocker arm 220 is offset or disconnected from the outlet 716 of the timing oil path 714 on the side 725 of the first rocker arm 210 (dashed circle in FIG. 16 is the projection of the outlet 715 on the side 725).

When the engine braking is required, the brake oil feed valve 50 (the conventional valve without timing function which can be turned on or off at a random engine timing) is turned on to feed oil to the timing oil passage 713 in the second rocker arm 220 through the oil passage 211 in the rocker arm shaft 205. However, at this time, the outlet 715 of the timing oil passage 713 in the second rocker arm 220 and the outlet 716 of the timing oil passage 714 in the first rocker arm 210 are misaligned (FIG. 16), the timing oil passage 714 leading to the directional valve 660 remains closed, the directional valve 660 is pressed against the bottom of the piston bore 690 by the spring 656, the oil feed passage 113 of the engine brake 100 is closed, the oil discharge passage 167 of the engine brake 100 is opened (FIG. 15), and the engine brake 100 cannot be turned on. Only when the cam-driven rocker arm of the engine rotates, for example, when the second rocker arm 220 rotates clockwise by a predetermined angle with respect to the first rocker arm 210 (FIG. 16), the outlet 715 of the timing oil passage 713 in the second rocker arm 220 will intersect and overlap with the outlet 716 of the timing oil passage 714 in the first rocker arm 210, the timing oil passages 713 and 714 are connected, the oil pressure overcomes the force of the spring 656 to move the directional valve 660 to the left, the annular groove 115 on the directional valve is aligned with the oil feed passage 113, and oil from the engine oil pump 10 flows to the engine brake 100 through the oil passage 151 in the rocker shaft 205; at the same time, the discharging passage 167 of the engine brake 100 is closed, and engine brake 100 is turned on.

When the engine braking is not required, the brake oil feed valve 50 (the conventional oil feed valve without timing function which can be turned on or off at a random engine timing) is turned off to discharge oil, but only when the outlet 715 of the timing oil passage 713 in the second rocker arm 220 intersects or overlap with the outlet 716 of the timing oil passage 714 in the first rocker arm 210 and the timing oil passages 713 and 714 are connected, the oil from the directional valve bore 690 can be forced to discharge from the timing oil passages 714 and 713 as well as the oil passage 211 in the rocker arm 205 to the brake oil feed valve 50. At this time, the directional valve 660, without oil pressure, moves toward the bottom (right) of the bore 690 under the action of the spring 656, closes the oil feed passage 113 to the engine brake 100 and simultaneously opens the oil discharge passage 167 of the engine brake 100 (FIG. 15), and the engine brake 100 is turned off after oil discharged.

In general, with the oil control timing mechanism of the present invention, the on or off of the engine brake 100 does not necessarily occur at the time when the brake oil feed valve 50 is turned on or off, but at a predetermined time or timing within the engine cycle when the valve timing system of the oil control timing mechanism is turned on.

The above description contains different specific embodiments, which should not be regarded as limiting the scope of the present invention, but as some specific examples representing the present invention from which many other variations are possible. For example, the multifunctional engine brake shown here can be used not only for top-mounted cam engines, but also for push rod/push tube engines. It can be used not only to drive the exhaust valve but also to drive the intake valve. It can be used not only for valve motion of engine braking, but also for exhaust gas recirculation, cold start, cylinder cutout and other engine variable valve motions.

In addition, many mechanisms shown here, such as the axial roller drive mechanism, the directional valve mechanism, the timing valve mechanism, the accumulator and the rocker arm mechanism, can have different shapes, sizes, positions and mounting modes.

Also, the engine brake here includes not only the roller shifting mechanism, two-stroke brake or one-point five-stroke brake, but also other forms of engine brake mechanisms and methods.

So the scope of the present invention should not be determined by the specific examples described above, but by the appended claims and their legal equivalents.

The invention claimed is:

1. A multifunctional engine brake comprising an engine valve motion conversion mechanism, wherein the engine valve motion conversion mechanism comprises camshaft, roller, roller shaft, roller shaft housing and an axial roller drive mechanism, wherein the camshaft has two or more different cams, wherein the roller shaft housing has a roller groove, wherein the two ends of the roller shaft are installed into the roller shaft housing, wherein the middle of the roller shaft spans the roller groove, wherein the length of the roller shaft in the roller groove is longer than the axial length of the roller, wherein the roller is arranged on the roller shaft in a rotatable way, wherein the roller is also slidable along the roller shaft, the roller has two or more axial positions on the roller shaft, wherein the axial roller driving mechanism comprises a piston driving mechanism arranged in the roller shaft, wherein the piston driving mechanism in the roller shaft moves the roller from one axial position to another axial position on the roller shaft, and wherein different engine valve motions are generated by switching the links between the roller and the different cams.

2. The multifunctional engine brake as claimed in claim 1, wherein the two or more different cams include a conventional ignition cam and an engine brake cam, and wherein the different engine valve motions include a conventional ignition valve motion and an engine brake valve motion.

3. The multifunctional engine brake as claimed in claim 1, wherein the piston drive mechanism comprises a drive piston and a drive spring arranged in the roller shaft, wherein one end of the drive piston is acted by fluid, and the other end of the drive piston is acted by the drive spring, and wherein the drive piston drives the roller on the roller shaft through a connector.

4. The multifunctional engine brake as claimed in claim 3, wherein the connector comprises at least one drive pin, wherein one end of the drive pin is arranged on the drive piston in the roller shaft, and the other end of the drive pin is connected with the roller on the roller shaft, and wherein the middle part of the drive pin passes through an axial groove on the roller shaft.

5. The engine valve movement conversion mechanism as claimed in claim 1, wherein the camshaft is parallel to the roller shaft, wherein the roller is linked to only one of the two or more different cams at each axial position on the roller shaft, and wherein the cam generates corresponding engine valve motion.

6. The multifunctional engine brake as claimed in claim 1, further comprising a seating velocity control mechanism, wherein the seating velocity control mechanism is arranged between one end of the roller shaft housing and the engine valve, wherein the seating velocity control mechanism comprises a positioning mechanism and a flow limiter, and wherein the flow through the flow limiter decreases with the reduction of the valve seating distance of the engine.

7. The multifunctional engine brake as claimed in claim 6, wherein the positioning mechanism comprises a connector and a positioning adjuster, wherein one end of the connector is fixed to the engine, wherein the positioning adjuster is arranged at the other end of the connector, wherein the flow limiter is arranged in the roller shaft housing, and wherein a positioning lash is arranged between the positioning adjuster and the roller shaft housing or the flow limiter.

8. The multifunctional engine brake as claimed in claim 1, further comprising a directional valve mechanism, wherein the directional valve mechanism controls the oil feeding and discharging of the axial roller drive mechanism.

9. The multifunctional engine brake as claimed in claim 1, further comprising an accumulator that reduces oil pressure fluctuation so that the oil is fed to the axial roller drive mechanism continuously and stably.

10. The multifunctional engine brake as claimed in claim 1, further comprising an oil control timing mechanism including a timing valve system that controls the timing or phase of oil feeding to or discharging from the engine brake.

11. The multifunctional engine brake as claimed in claim 10, wherein the roller shaft housing comprises a rocker arm of the engine, wherein the timing valve system comprises a directional valve, wherein the directional valve is positioned in the rocker arm, wherein when the rocker arm rotates to a predetermined angle, the timing valve system is turned on, the directional valve in the rocker arm is shifted, and oil is fed to or discharged from the engine brake.

12. The multifunctional engine brake as claimed in claim 11, wherein the timing valve system further comprises a timing piston and a timing piston stop mechanism, wherein the timing piston is positioned in the rocker arm at a predetermined position by the timing piston stop mechanism, and in the predetermined position, the timing piston closes the oil passage to the directional valve, wherein when the cam drives the rocker arm to rotate, the timing piston makes a relative movement in the rocker arm, wherein when the relative movement is greater than a predetermined distance, the timing piston opens the oil passage to the directional valve, the directional valve in the rocker arm is shifted, and oil is fed to or discharged from the engine brake.

13. An oil control timing method for driving an engine brake, comprising an oil control timing process using an oil control timing mechanism to control an oil feeding time or an oil discharging time of the engine brake, the engine brake comprises a no-timing brake oil feed valve, the oil control timing mechanism comprises a timing oil passage connecting the brake oil feed valve with a timing valve system, the timing valve system controls the timing or phase of oil filling or oil discharging of the engine brake, wherein the oil control timing process comprises the following steps: first, turning on the brake oil feed valve, secondly, turning on the timing valve system for a predetermined period of time or phase within the engine cycle, and finally, feeding oil to or discharging oil from the engine brake.

14. The oil control timing method for driving the engine brake as claimed in claim 13, wherein the timing valve system comprises a directional valve located in the rocker arm of the engine, and wherein when the rocker arm rotates to a predetermined angle, the timing valve system opens an oil passage to the directional valve, the oil pressure drives the directional valve in the rocker arm to move, and oil is fed to or discharged from the engine brake.

15. The oil control timing method for driving the engine brake as claimed in claim 14, wherein the timing valve system further comprises a timing piston and a timing piston stop mechanism, wherein the timing piston is positioned at a predetermined position by the timing piston stop mechanism in the rocker arm of the engine, wherein in the predetermined position, the timing piston closes the oil passage to the directional valve, wherein when the cam drives the rocker arm to rotate, the timing piston makes a relative movement in the rocker arm, wherein when the relative movement is greater than a predetermined distance, the timing piston opens the oil passage to the directional valve, the oil pressure drives the directional valve in the rocker arm to move, and oil is fed to or discharged from the engine brake.

16. A multifunctional engine brake, comprising a camshaft comprising two different cams;

a roller, a roller shaft having two ends disposed in the roller shaft housing, wherein the roller is rotatably disposed on the roller shaft, wherein the roller is slidable along the roller shaft;

a roller shaft housing comprising a roller groove, the roller shaft spanning the roller groove; and an axial roller drive mechanism that moves the roller from one axial position to another axial position on the roller shaft, wherein when the roller is in one of the two axial positions, the roller is engaged with one of the two cams, and wherein when the roller is in the other of the two axial positions, the roller is engaged with the other of the two cams.

17. The multifunctional engine brake as claimed in claim 16, wherein the two cams include a conventional ignition cam and an engine brake cam.

18. The multifunctional engine brake as claimed in claim 16, further comprising a drive piston and a drive spring disposed in the roller shaft, wherein one end of the drive piston is acted by fluid, and the other end of the drive piston is acted by the drive spring, and wherein the drive piston drives the roller on the roller shaft.

19. The multifunctional engine brake as claimed in claim 18, wherein the drive piston drives the roller on the roller shaft through a drive pin, wherein one end of the drive pin is engaged with the drive piston, and the other end of the drive pin is engaged with the roller, and a middle part of the drive pin passes through an axial groove on the roller shaft.

20. The engine valve movement conversion mechanism as claimed in claim 16, wherein the camshaft is parallel to the roller shaft, wherein the roller is engaged with one of the two cams at each axial position on the roller shaft.

21. The multifunctional engine brake as claimed in claim 16, further comprising a seating velocity control mechanism, wherein the seating velocity control mechanism is arranged between one end of the roller shaft housing and the engine valve, wherein the seating velocity control mechanism comprises a positioning mechanism and a flow limiter, and wherein the flow through the flow limiter decreases with the reduction of the valve seating distance of the engine.

22. The multifunctional engine brake as claimed in claim 21, wherein the positioning mechanism comprises a connector and a positioning adjuster, wherein one end of the connector is fixed to the engine, and the positioning adjuster is arranged at the other end of the connector, wherein the flow limiter is arranged in the roller shaft housing, and wherein a positioning lash is arranged between the positioning adjuster and the roller shaft housing or the flow limiter.

23. The multifunctional engine brake as claimed in claim 16, further comprising a directional valve mechanism, wherein the directional valve mechanism controls the oil feeding and discharging of the axial roller drive mechanism.

24. The multifunctional engine brake as claimed in claim 16, further comprising an accumulator that reduces oil pressure fluctuation so as to stabilize the oil fed to the axial roller drive mechanism.

25. The multifunctional engine brake as claimed in claim 16, further comprising an oil control timing mechanism including a timing valve system that controls the timing or phase of oil feeding to or discharging from the engine brake.

26. The multifunctional engine brake as claimed in claim 25, wherein the roller shaft housing comprises a rocker arm of the engine, and wherein the timing valve system comprises a directional valve, wherein the directional valve is positioned in the rocker arm, wherein when the rocker arm rotates to a predetermined angle, the timing valve system is turned on, the directional valve in the rocker arm is shifted, and oil is fed to or discharged from the engine brake.

27. The multifunctional engine brake as claimed in claim 26, wherein the timing valve system further comprises a timing piston and a timing piston stop mechanism, wherein the timing piston is positioned in the rocker arm at a predetermined position by the timing piston stop mechanism, and in the predetermined position, wherein the timing piston closes the oil passage to the directional valve, wherein when the cam drives the rocker arm to rotate, the timing piston makes a relative movement in the rocker arm, and wherein when the relative movement is greater than a predetermined distance, the timing piston opens the oil passage to the directional valve, the directional valve in the rocker arm is shifted, and oil is fed to or discharged from the engine brake.

* * * * *